United States Patent [19]

DeLorge

[11] 4,087,091

[45] May 2, 1978

[54] SPINNER APPARATUS FOR PLAYING THROW GAME

[76] Inventor: Raymond F. DeLorge, 20 Alden Ave., Enfield, Conn. 06082

[21] Appl. No.: 762,001

[22] Filed: Jan. 24, 1977

[51] Int. Cl.[2] ..... A63F 9/02

[52] U.S. Cl. ..... 273/95 R; 273/102.1 E; 273/102.4; 273/142 JA

[58] Field of Search ..... 273/95 R, 97 R, 98, 273/85 R, 102.1 R, 102.1 C, 102.1 E, 102.4, 106 R, 142 J, 142 JA, 142 JC, 102 R, 1 R

[56] References Cited

U.S. PATENT DOCUMENTS

| | | | |
|---|---|---|---|
| 285,396 | 9/1883 | De Windt | 273/102 R |
| 1,136,345 | 4/1915 | Kempien | 273/142 JA |
| 2,192,430 | 3/1940 | Branner | 273/1.5 R UX |
| 2,208,086 | 7/1940 | Singer | 273/97 R |
| 2,893,734 | 7/1959 | Tarte, Jr. | 273/85 R |
| 3,023,003 | 2/1962 | Hayter | 273/98 X |
| 3,092,387 | 6/1963 | Wagner | 273/95 R |
| 3,207,515 | 9/1965 | Mireider | 273/95 R X |
| 3,749,401 | 7/1973 | Hayko | 273/95 R |

FOREIGN PATENT DOCUMENTS

| | | | |
|---|---|---|---|
| 623,505 | 3/1927 | France | 273/102.1 E |

*Primary Examiner*—William H. Grieb

*Attorney, Agent, or Firm*—Leonard S. Michelman

[57] ABSTRACT

The game herein described has a board upon which there is mounted a basket. The basket has a reduced-in-size lower portion beneath which is a flapper assembly. When the player makes a basket with the throw of a bean bag, which passes through the inside of the basket, at the bottom of the basket, the bean bag actuates an elevated part of the flapper which is hereinafter referred to as a flat surface. The weight and force upon the flat surface, causes the arm which is pivotally mounted and integral with it, to move and causes a flapper pointer to engage selector pins which are radially mounted on a spinner wheel, causing the spinner wheel to rotate. A pointer mounted at a top position above the spinner wheel indicates the indicia upon the spinner wheel which gives the player the number of points he has scored.

10 Claims, 9 Drawing Figures

Fig. 1
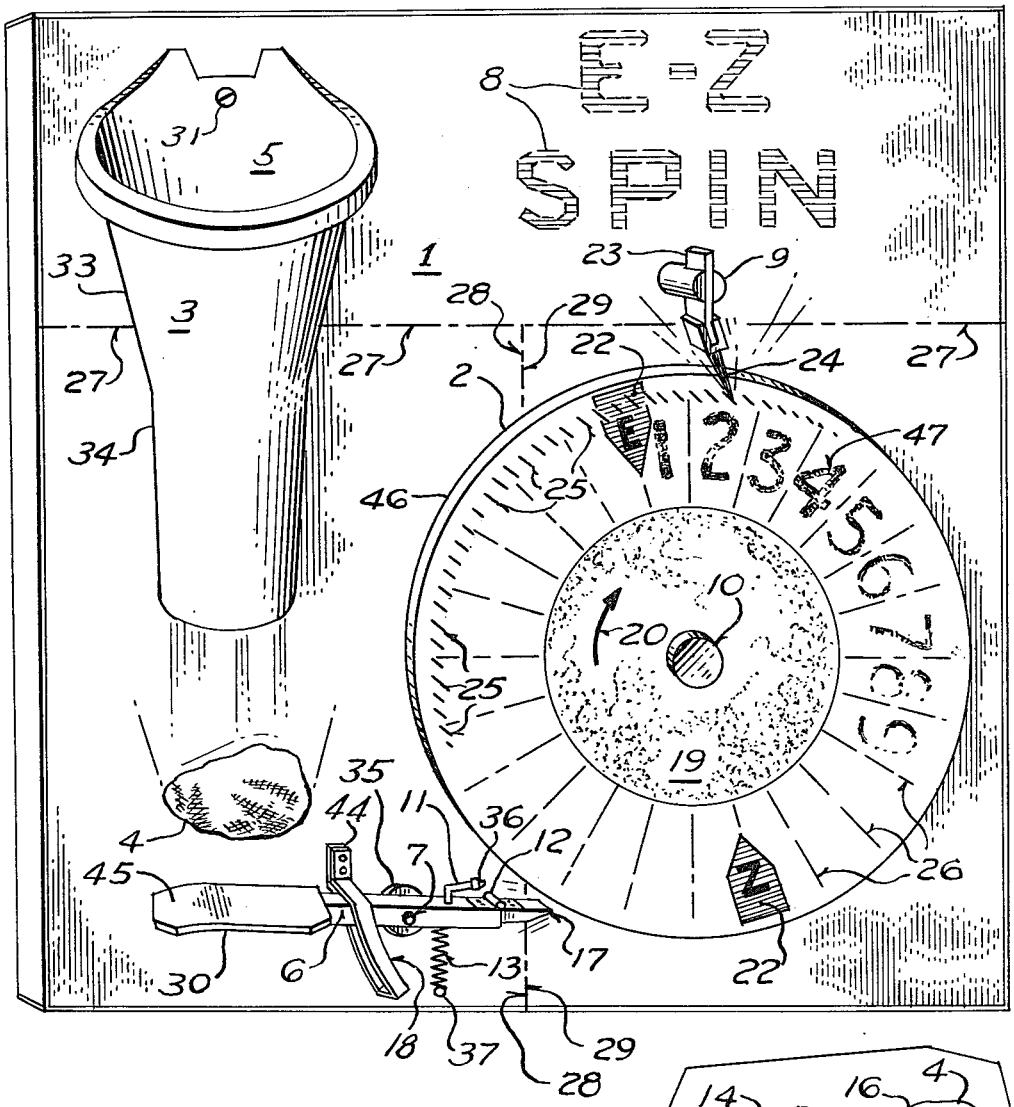
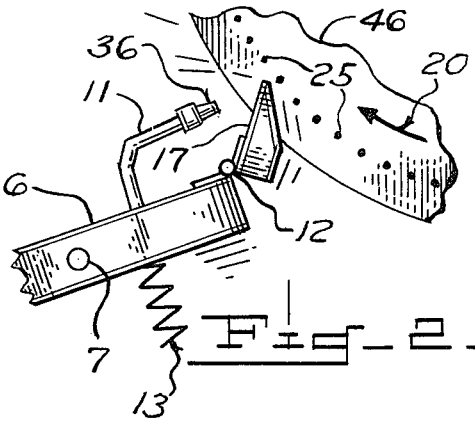
Fig. 2
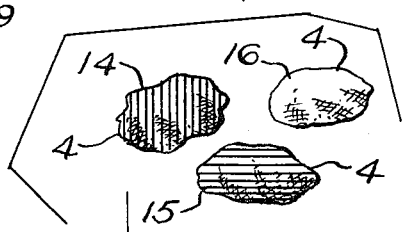
Fig. 3
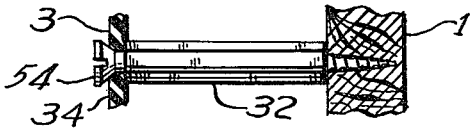
Fig. 4

1
3
5
6
7
9
10
11
12
13
17
18
23
24
25
30
32
35
36
37
38
39
40
41
42
43
44
45
46
48

SPINNER APPARATUS FOR PLAYING THROW GAME

This invention is concerned with an amusement apparatus and particularly an article of manufacture which is used to play a game.

It is an object of the within invention to provide a game utilizing the skill of throwing a bean bag into a basket.

It is another object of the within invention to provide an amusement device upon which a basket is employed in a novel arrangement to spin a wheel to determine the score of the player.

It is yet a further object of the within invention to provide a game utilizing the skill of being able to throw a bean bag or a heavy round or square object into a basket, and when it drops out of the basket to engage a spinner wheel so as to spin it and have it stop at the highest number to give to the player, his score.

It is still an additional object of the within invention to provide a game that is simple to construct, durable, easy to play, and inexpensive to manufacture.

These and other objects are obtained by the details of structure shown in the drawings and in the specification hereinafter recited, in which:

FIG. 1 is a view from the front in perspective of the game board assembly.

FIG. 2 is an exploded front view of the assembly which imparts motion to the spinner wheel.

FIG. 3 is a perspective view showing three different types of bean bags that are used in the playing of the game.

FIG. 4 is a side elevational view of the bracket assembly which supports and spaces the bottom portion of the basket with the board.

Figures 5, 6, 7, 8, 9:
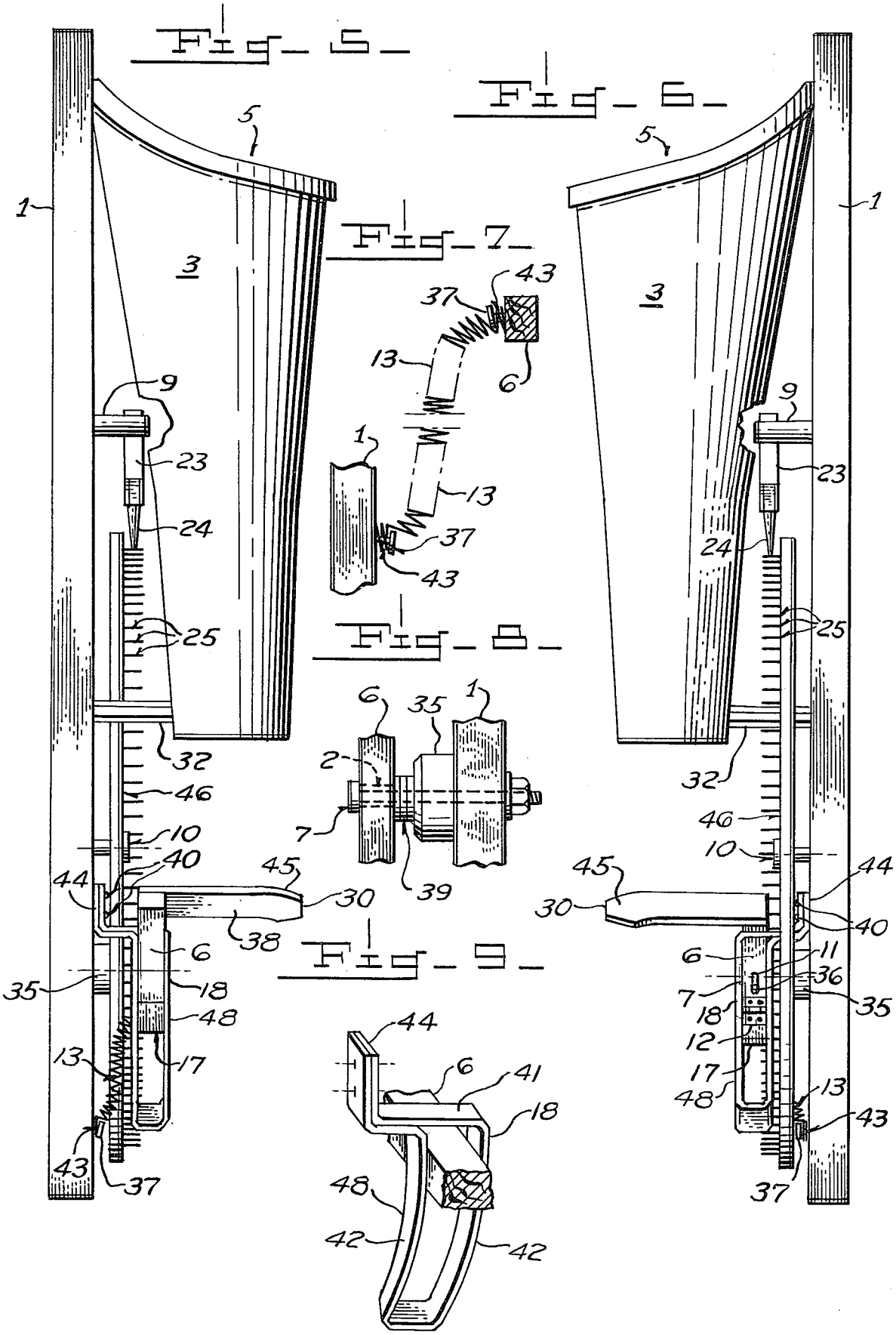
FIG. 5 is a side elevational view of the game board looking from the left side of FIG. 1.
FIG. 6 is a side elevational view of the game board looking from the right side of FIG. 1.
FIG. 7 is an exploded side view of the spring assembly that controls the repositioning of the flapper assembly.
FIG. 8 is a side elevational view of the supporting assembly for mounting the flapper so that it can be rotably moved.
FIG. 9 is a perspective view of the apparatus for controlling the displacement of the flapper so that it will not swing too high or too low.

The device is mounted on a board 1 which is somewhat analagous to a basketball backboard in that the basket is mounted thereupon. The board is, of course, decorated having the name of the game appearing thereupon as at 8. The board 1 has also mounted thereupon the spinner wheel 46.

The spinner wheel 46 is circular in shape. It circumscribes a wheel pivot bearing at 10. There are numbers 47 on the face of the wheel 46. The numbers are separated by the dividing lines 26. At opposite ends of the spinner wheel 1 are the initials of the name of the game indicated by the numeral 22. It shall be subsequently observed that in playing the game, if the spinner stops at either one of these positions, there are bonus points given to the player. Pins 25 are also mounted on the face of the board 1. The wheel 46 rotates when it is actuated in a clockwise direction indicated at 20. In order to make for a better appearance there is a metallic material 19 distributed in the area between the segments where the numbers 47 appear, which gives to the board a glittering effect when the wheel is spinning.

Mounted above the wheel is the pointer assembly comprising a slotted cylinder 9, and a body member 23 having a pointer 24. It is contemplated that the body member 23 will be made of leather and will hang from the support cylinder 9.

Because of friction, the wheel 46 will cease rotating in a clockwise direction 20 and the leather pointer 24 will be pointing at one of the numbers or letters where the wheel ultimately stops. For example in FIG. 1, pointer 24 is directed at number 2.

The board 1 is painted so as to give a pleasant appearance. In the embodiment disclosed, white paint is used in the area at the top of the board and painted thereover are the letters E-Z SPIN endorsing on the board the name of the game. A line 27 denotes the boundary line between the colors of the different areas. In the preferred embodiment, a blue color is used behind the wheel and is in the area within the line 27 and line 29. On the other side of line 29 which is indicated by 28, and below 27, the coloring is red. The spinner wheel 46 is secured on the rear side of the board 1 by a typical nut and washer assembly. A basket 3 having an opening 5 is supported on the board 1 by the mounting screw 31. In a preferred embodiment, the upper portion of the basket is red so that it gives a contrast with the white part of the board while the bottom segment of the basket 3 is painted blue giving a contrast with the red part of the board.

A bean bag 4 or a weighted ball may be used with this game. In the embodiment shown a bean bag 4 is employed. It is, however, within the contemplation of the game that the changing of the size or shape of the bean bag 4 would be within the spirit and scope of the invention. The bean bag 4 when it drops down through the basket opening 5, exerts forces on a flapper surface 30. The flapper function and assembly are described as follows:

Flapper surface 30 is shaped in a convex manner as at 45. Surface 30 is mounted on the flapper arm 6. There is a pivot pin 7 which passes through an opening in the flapper arm 6. Reference is made to the view of FIG. 8 in order to see the details of construction of the pivot assembly for the flapper arm 6. The pin 7 passes through the arm 6 through the inside of a washer 39 through the center of a spacer 35 and through an opening in the board 1. The arm 6 will rotably move about the pin 7 within the confines of the area as hereinafter described.

A metal bushing 2 is mounted inside the opening within the arm 6. The bushing 2 prevents the rotation of the arm 6 on pin 7 from wearing out the opening within the arm 6 and gives to the device a long life of motion. The bushing 2 also enables the arm 6 to move freely with less influence from the friction forces. At the end of the arm 6 is mounted a hinge 12 upon which is also mounted a flapper member 17 which is of a size and dimension to engage the pins 25 on the rotatable spinner wheel 46. Occasionally the flapper 17 will bend back all the way on the hinge 12 and it is therefore necessary to have a stop member 11 upon which is mounted a rubber tip 36 to prevent the flapper from bending back and becoming inoperable. It is necessary for the arm 6 and flapper 17 to be returned to their normal position on the pin 7; and in order to insure that this return to position will take place, a spring 13 which is helical in shape is connected to the lower surface of the arm 6 and is secured to the board 1 by means of the pins 37. For the details of this arrangement, reference is made to the views of FIG. 2 and FIG. 7. In FIG. 7 a few coils 43 of the spring 13 are secured to the board 1 with the large head pin 37. The spring 13 is engaged at its other end in a similar matter by another pin 37 with a large head mounted on a surface of the arm 6. In order to prevent too great a displacement of the arm 6 as it tilts back and forth on pin 7, a stop and guide member 18 is employed. This can be clearly seen in the view of FIG. 9. There is a flange 44 which permits the assembly to be mounted by screws on the board 1. Extending horizontally and outwardly from the flange 44 is the flat metal bracket 41 which bends down vertically therefrom after it passes over the flapper arm 6 as shown. The arm 6 must rotate within the opening provided by the walls 42 of the said stop and guide assembly 18. In the view of FIG. 5 the bottom surface 38 of the convex shaped flapper 45 can be seen.

The bean bags 4 are shown by the graphical symbols as being of different colors: for example, 14 is red; 15 is blue; and 16 is white. It is within the spirit and scope of this invention to use any other colors or combination thereof as already mentioned, with any other shapes or types of weighted balls or the like. The pointer 9 is preferably made of leather giving to it resiliency although it may not be necessary to have leather all the way through and it is within the spirit and scope of this invention to use a substituted material.

In order to maintain the basket 3 in a fixed position besides having it mounted by a mounting screw at 31, a spacer mounting arrangement, which is shown in detail in the view of FIG. 4, is employed. There is an opening at the rear portion of basket 3.

A long flanged head wood screw 54 passes through the opening and then through a spacer 32 which is hollow inside and is in the shape of a cylinder. Spacer 32 is located in the blue lower surface 34 of the basket 3. The long flange head wood screw 54 which passes through the spacer 32 secures same to the board 1. It is within the spirit and scope of this invention to use some other type of supporting arrangement without deviating herefrom.

The purpose of the details of structure shown in FIG. 4 is to insure that the basket 3 will not be disengaged from the supporting panel 1.

The spinner wheel 46 is mounted on the bolt 10. This may be seen in the view of FIG. 6 and FIG. 1. The spindle 10 is in fact a bearing assembly which engages the board 1 and permits the wheel to spin freely thereupon.

After the operation of the game is explained, one will realize how it is to enjoy the playing of the game for which the apparatus herein described has been provided. The player of the game takes one of the bean bags 4. He stands a distance away from the basket 3. He throws the bag towards the opening 5 in the basket 3. If he is skillful the bag will go into the opening of the basket 5, fall down into a position as shown in FIG. 1 and complete its locus by falling onto the convex surface 45 of the flapper arm 6. The flapper arm 6 will then tilt and its flapper end 17 will go upwardly from the pivot 7 and make contact with the pins 25 on the surface of the spinner wheel 46. The bean bag 4 will fall from the convex surface 45 after it has actuated the arm 6; and the pointer 17, mounted on the hinges 12, will impart a push force on the pins 25 of the spinner wheel 46 causing it to rotate in a clockwise direction 20 on the bearing 10. The flapper pointer 24 causes a friction force slow down, as it contacts the pins 25. The wheel 46 will stop shortly thereafter at a position indicated, for example, in the view of FIG. 1 wherein the pointer 24 has stopped at a number 2. The player will now have obtained 2 points. He can keep score on a separate sheet of paper or in a more luxurious arrangement of the within invention wherein a score board can be mounted as an auxiliary to the board to keep score for each individual. If the player has three throws, he will continue this procedure until he has accumulated his point total. Then his opponent, will make three throws and accumulate his points.

There are bonus points that can be obtained as previously mentioned as positions 22 where the words E and Z, which represent the name of the game, are located. The amount of the bonus points can be determined before the game commences by an agreement between the players. More than two people can play the game. The rules can be varied to simulate innings like in baseball and with balls and strikes, like in basketball with field goals, or in hockey or soccer and so on.

I claim:

1. A recreational apparatus comprising: a board, an open funnel shaped member, means for securing said funnel shaped member to said board, a spinner wheel having indicia disposed in a circle on a face thereof, means for rotatably securing said wheel to said board, said wheel being located in a position adjoining said funnel shaped member, a flapper assembly, means for securing said flapper assembly to said board in a position beneath the funnel shaped member and adjacent to said spinner wheel, a bean bag, means on said flapper assembly for contact by said bean bag, means in said flapper assembly for actuating the spinner wheel to rotate, whereby when said bean bag passes through the funnel shaped member and contacts said flapper assembly, it imparts forces on said flapper assembly causing said actuating means to rotate said spinner wheel, and indicating means on said board in contact with said spinner wheel for pointing to one fo the indicia on the spinner wheel when said wheel stops.

2. A recreational apparatus as described in claim 1 whereby said flapper assembly comprises a flat surface being convex at its extremity, a flapper arm, said flat surface mounted on said flapper arm, a pivot pin, said flapper arm being mounted on said pivot pin, a stopguide mounted on said board, said arm passing within said stopguide, and means mounted at the end of said arm adapted to engage the said pins.

3. A recreational apparatus as described in claim 1 wherein said means in said flapper assembly for activating the spinner comprises an arm, a hinge, a flapper having a beveled edge, said hinge mounted between said flapper and said arm whereby said flapper can be moved upwardly from the horizontal, a stop mounted on top of said arm for controlling the distance of movement of said flapper.

4. A recreational apparatus as described in claim 2 wherein said means in said flapper assembly for activating the spinner comprises a hinge, a flapper having a beveled edge, said hinge mounted between said flapper and said arm whereby said flapper can be moved upwardly from the horizontal, a stop mounted on top of said arm for controlling the distance of movement of said flapper.

5. A recreational apparatus as described in claim 2 wherein the flapper arm has mounted thereon between the end thereof that engages the pins on the spinner and the pivot pin, a spring for causing the flapper arm to return to its stationary position after motion is imparted to it from the forces applied to said flat surface, said spring being anchored on said board.

6. A recreational apparatus as described in claim 4 wherein the flapper arm has mounted thereon between the end thereof that engages the pins on the spinner and the pivot pin, a spring for causing the flapper arm to return to its stationary position after motion is imparted to it from the forces applied to said flat surface, said spring being anchored on said board.

7. A recreational apparatus as described in claim 2 wherein said stop-guide comprises a vertical support portion with screw holes therein adapted to be supported on said board, a horizontal portion extending over the said arm a predetermined distance, and then extending downwardly and substantially vertically a predetermined distance below the said arm, then extending horizontally below said arm a predetermined distance, and then extending upwardly a predetermined distance substantially parallel to said first vertical portion and being connected with the said vertical support portion.

8. A recreational apparatus as described in claim 3 wherein said stop-guide comprises a vertical support portion with screw holes therein adapted to be supported on said board, a horizontal portion extending over the said arm a predetermined distance, and then extending downwardly and substantially vertically a predetermined distance below the said arm, then extending horizontally below said arm a predetermined distance, and then extending upwardly a predetermined distance substantially parallel to said first vertical portion and being connected with the said vertical support portion.

9. A recreational apparatus as described in claim 5 wherein said stop-guide comprises a vertical support portion with screw holes therein adapted to be supported on said board, a horizontal portion extending over the said arm a predetermined distance, and then extending downwardly and substantially vertically a predetermined distance below the said arm, then extending horizontally below said arm a predetermined distance, and then extending upwardly a predetermined distance substantially parallel to said first vertical portion and being connected with the said vertical support portion.

10. A recreational apparatus as described in claim 6 wherein said stop-guide comprises a vertical support portion with screw holes therein adapted to be supported on said board, a horizontal portion extending over the said arm a predetermined distance, and then extending downwardly and substantially vertically a predetermined distance below the said arm, then extending horizontally below said arm a predetermined distance, and then extending upwardly a predetermined distance substantially parallel to said first vertical portion and being connected with the said vertical support portion.

* * * * *